US007273130B2

(12) United States Patent
Zillmann

(10) Patent No.: US 7,273,130 B2
(45) Date of Patent: Sep. 25, 2007

(54) DEVICE AND METHOD FOR ACTIVE SOUNDPROOFING, AND POWER UNIT FOR AEROPLANES

(75) Inventor: Joergen Zillmann, Munich (DE)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 10/520,420

(22) PCT Filed: Jul. 9, 2003

(86) PCT No.: PCT/DE03/02292

§ 371 (c)(1),
(2), (4) Date: Jan. 6, 2005

(87) PCT Pub. No.: WO2004/017301

PCT Pub. Date: Feb. 26, 2004

(65) Prior Publication Data

US 2005/0236225 A1 Oct. 27, 2005

(30) Foreign Application Priority Data

Jul. 16, 2002 (DE) ..... 102 32 291

(51) Int. Cl.
*F01N 1/16* (2006.01)
*F02B 27/02* (2006.01)

(52) U.S. Cl. ..... 181/271; 181/237; 181/254; 181/255; 60/324

(58) Field of Classification Search ..... None
See application file for complete search history.

(56) References Cited

U.S. PATENT DOCUMENTS 5,283,398 A * 2/1994 Kotera et al. ..... 181/224
6,069,840 A 5/2000 Griffin et al.
6,112,514 A 9/2000 Burdisso et al.
6,349,541 B1 * 2/2002 Gruden et al. ..... 60/312
6,523,889 B2 * 2/2003 Birndorfer et al. ..... 296/217

(Continued)

FOREIGN PATENT DOCUMENTS

DE 4228356 A1 3/1994

(Continued)

OTHER PUBLICATIONS

Paul M. Radavich et al., "A Computational Approach for Flow-acoustic Coupling in Closed Side Branches," Journal of the Acoustical Society of America, Apr. 2001, pp. 1343-1353.

(Continued)

*Primary Examiner*—Lincoln Donovan
*Assistant Examiner*—Eduardo Colon Santana
(74) *Attorney, Agent, or Firm*—Crowell & Moring LLP

(57) ABSTRACT

A device for active noise reduction has a chamber, which is arranged laterally in relation to a gas flow, and a chamber opening constructed in one wall of the chamber. In the area of the chamber opening, a deflection device is adjustably arranged. The deflection device, in a first position, at least partially directs the gas flow running by the chamber opening into the chamber, in order to compress air there, and, in a second position, directs the gas from the chamber to the gas flow, in order to release the gas inside the chamber. The resulting alternating pressure inside the chamber is radiated through the chamber opening as sound and overlays the disturbing sound.

17 Claims, 1 Drawing Sheet

U.S. PATENT DOCUMENTS

| | | | | |
|---|---|---|---|---|
| 6,607,432 | B2 * | 8/2003 | Schaake | 454/143 |
| 2001/0018826 | A1 * | 9/2001 | Rusch | 60/286 |
| 2002/0129863 | A1 * | 9/2002 | Schaake et al. | 138/177 |
| 2004/0094360 | A1 * | 5/2004 | Toyoshima | 181/249 |
| 2004/0261404 | A1 * | 12/2004 | Vignassa et al. | 181/227 |
| 2005/0217930 | A1 * | 10/2005 | Horikou | 181/250 |

FOREIGN PATENT DOCUMENTS

| | | | |
|---|---|---|---|
| DE | 29611884 | U1 | 12/1997 |
| DE | 29715756 | U1 * | 3/1998 |
| DE | 20003519 | U1 | 7/2000 |
| JP | 59070868 | A * | 4/1984 |
| JP | 6-348280 | | 12/1994 |

OTHER PUBLICATIONS

Edmane Envia, "Fan Noise Reduction: An Overview," Aeroacoustics vol. 1, No. 1, 2002, pp. 43-62.

B. E. Walker et al., "Active Resonators for Control of Multiple Spinning Modes in an Axial Flow Fan Inlet," American Institute of Aeronautics & Astronautics, 1999, pp. 339-348.

C Pitelet et al., "Optimization of Flow Distortions for Fan Noise Reduction with One-Sided Actuators," 7th AIAA/CEAS Aeroacoustics Conference, May 28-30, 2001.

* cited by examiner

DEVICE AND METHOD FOR ACTIVE SOUNDPROOFING, AND POWER UNIT FOR AEROPLANES

BACKGROUND AND SUMMARY OF THE INVENTION

The present invention relates to a device for active noise reduction, the use of such a device in an engine, especially an aircraft engine, a procedure for active noise reduction, and an engine for aircraft.

The reduction of sound and the reduction of high sound levels are of increasing importance. Especially in the area of aircraft engines, measures for noise protection and noise reduction are required on a large scale for environmental reasons as well as for comfort.

In particular, active noise reduction measures and hybrids are known in the state of the art. An active technology is for example described in the journal Aeroacoustics, Volume 1, Number 1, 2002, page 53. There, loudspeakers in the form of vibrating membranes are used to produce a secondary sound field, which cancels out the primary sound field. Moreover, the loudspeakers or actuators are arranged in the immediate vicinity of the source of the sound in the primary sound field, specifically, on the stator blades of an engine. The problem exists, however, that only very little space is available for the installation of the actuators, and the stator blades are moreover constructed very thin. Furthermore, the sound levels produced are very low, due to the limited installation space available, so that only a very small portion of the primary sound field can be reduced. That means that the production of high sound levels is almost impossible in acoustic actuators, since the size of the construction, weight and power consumption are too high for many applications.

When vibrating membranes which are driven by electromagnetic converters, such as electrodynamic converters or converters, which utilize the piezoelectric effect, are being used, the mechanical-acoustic degree of efficiency of the vibrating membranes is generally very low. In addition, large surfaces are needed for low frequencies. Therefore, in applications in which construction size, weight and power consumption are very restricted, high sound levels, which would be suitable for largely extinguishing a primary sound field, can barely be suitably generated with acoustic actuators or vibrating membranes.

Furthermore, hybrid concepts, in which passive elements are used to absorb sound, are known. These often utilize resonance properties, for example by using Helmholtz resonators. An active Helmholtz resonator for the absorption of sound in an engine is shown on page 52 of the already above mentioned journal Aeroacoustics, Volume 1, Number 1, 2002. Since the effect of a Helmholtz resonator is limited to a small frequency range, active elements are employed in order to adjust the properties of the resonator to the given requirements, for example to the changes in RPM of the rotor.

In the article 'Active Resonators for Control of Multiple Spinning Modes in an Axial Flow Fan Inlet' by B. E. Walker and A. S. Hersh, 1999, American Institute of Aeronautics & Astronautics, pages 339-343, actively controlled Helmholtz resonators, which are used in noise reduction in engines, are described as well. For adjustment to the given frequencies, the volume of the Helmholtz resonators is controlled by means of actuators.

Although these hybrid concepts or technologies do improve on the existing, purely passive concepts, nonetheless, no secondary sound field is generated, and no cancellation of sound is achieved.

In the article 'Optimization of Flow Distortions for Fan Noise Reduction with One-Sided Actuators', C. Pietelet et al., AIAA 2001-2219, interference rods are mounted in the intake of a engine, which by themselves do not generate any sound. The rods, however, do cause an interference in the inflow of the rotors, by means of which secondary sound is radiated from the rotor. These types of constructions, however, do have a disadvantage, in that it is very difficult to adapt them to changes in the primary sound field, and they are consequently very inflexible. Another disadvantage is the negative impact on the aerodynamics of the rotors, as well as significant problems in complying with safety criteria and safety regulations.

Furthermore, in the state of the art, tones caused by subjecting cavities to flow are suppressed. Here, the sound is caused by instabilities in the flow. The cavities strongly excite these flows for certain frequencies, which results in very loud sounds. In order to suppress these tones and prevent the resulting sound, actuators are employed. By means of the actuators, resonance properties are influenced in such a way that the instability of the flow is not excited. Thus, the interaction of the instability with the resonance properties of the chamber is prevented.

In German publication DE 296 11 884 U1, anti-noise is generated in a waste gas duct by means of a loudspeaker. There a chamber is arranged between the loudspeaker and the waste gas duct in order to produce overpressure in front of the loudspeaker, and thereby protect the loudspeaker from aggressive gases, combustion residues, dust, etc. from the waste gas duct.

In light of the disadvantages of the state of the art described above, the objective of the present invention is to present a device and a procedure for noise reduction, in which very loud sound levels can be produced, and in which on the other hand only very low power is required. Furthermore, an aircraft engine is to be created which is very silent in operation, whereby only very little installation space and low power supply have to be provided for active noise reduction.

The objective is accomplished by the claimed device for active noise reduction by application of the claimed device, by the claimed method for active noise reduction, and by the claimed engine for aircraft. Additional advantageous features, aspects and details of the invention are presented in the claims, the description and the drawings.

The device of the invention for active noise reduction has a housing, in which a chamber is constructed, and a chamber opening, which is constructed in a wall of the chamber, whereby the chamber opening is arranged or is to be arranged laterally in relation to a gas flow, and whereby an adjustable deflection device is arranged at one chamber opening. In a first position, the device directs the gas flow streaming along the chamber opening at least partially into the chamber, in order to compress the gas there, and, in a second position, the device guides the gas from the chamber to the gas flow, in order to release the gas inside the chamber.

In this way, very high sound levels can be generated during operation, which overlay a primary sound field and cancel it out at least partially, whereby the size of construction, the weight and power consumption can be kept at a low level. The device of the invention provides a high degree of efficiency. The required power is drawn from the gas or air flow, whereby this air flow may be constant. Only a little power is needed for the control, which is merely used to deflect the air flow. The construction of the device of the invention is relatively simple, and only takes up little space and weight.

In the present invention, for the generation of high sound pressures, an aeroacoustic sound origination mechanism is utilized, which is also responsible for the generation of sound, when whistles and cavities are blown against. Thereby, the sound origination is triggered by instabilities in the flow of the free boundary layer. These fluctuations of pressure and velocity in the flow get coupled with an acoustic resonator. The resonator, which is formed by the chamber, causes an acoustic feedback of the fluctuation portions at the site of origination of the free boundary layer. For certain frequencies, this response of the resonators generates acoustic feedback conditions, which excite the instability, i.e. a resonance is formed. After a certain transient response time, strong fluctuations in pressure are generated in the resonator by means of this action and radiated off as sound. In the event of resonance, the instability has been ignited to such a degree that the free boundary layer flow is guided into and out of the resonator volume in the rhythm of the resonance frequency. This is the cause for the compression of the fluid particles. Here, the fact that the conversion of velocity fluctuations into acoustic pressure fluctuations in the resonator volume is a very effective process is utilized. The fluid particles are directly compressed and decompressed, which is characteristic of the sound origination mechanism itself.

The present invention utilizes these effects in a beneficial form, in order therewith to reduce the sound in a flow or in a flow duct. However, the stochastic excitation due to the instability in the boundary layer flow is dispensed with, and a deflection device is used instead. This device allows for a deterministic excitation of the sound origination process, or the guidance of air flow into or out of the chamber volume.

Since both phase and amplitude of the generated sound field can be regulated by the deflection device control unit, this sound generator is suitable for active sound regulation.

An alternating pressure is generated in the chamber by means of the adjustably arranged deflection device, and is radiated off as sound through the chamber opening. This radiated sound overlays the primary sound field and reduces it.

In this way, the frequency of the radiated sound may be determined by the duration, during which the deflection device is in the first position and in the second position. The phase of the sound pressure fluctuations has a fixed relationship to the phase of the phase of the air flow introduced into the chamber. The sound pressure is thereby dependent on the amount of air introduced into the chamber, or the amplitude of the excitation signal for the deflection device and the chamber volume.

Advantageously, the deflection device includes a gate, which is pivoted around the axis, whereby the axis is ed vertically toward the direction of flow of the gas flow. The device of the invention can thereby be realized with especially low expenditure for construction.

The deflection device may also be designed as a unilaterally fixed, oscillating plate.

The chamber is preferably designed as resonator, whereby the deflection device is positioned on an upstream positioned edge of the chamber opening. Preferably, the air flow is directed proportionally toward the excitation signal of the deflection device.

Preferably, a flow duct for the gas flow is arranged at least upstream from the chamber opening, which serves to guide the gas flow around the chamber opening. The flow duct may either be a part of the device of the invention, or the device of the invention may be designed in such a way that an existing flow duct, for example in an engine, is correspondingly utilized.

Advantageously, the deflection device has a deflection surface, which, in the initial position, is facing the gas flow and is aligned diagonally toward the gas flow, and in the second position, is opposite the gas flow and is aligned diagonally toward the gas flow. In this way, with relatively little expenditure, an exact deflection of the gas flow to the chamber, or part of it, may be achieved, just as it allows for the gas situated in the chamber in the second position of the deflection device to be released exactly.

Advantageously, the device includes a control and/or drive unit, which is coupled to the deflection device. The deflection device may, for example, include an elastic element.

In this way, resetting force is exerted onto the deflection device, which acts in the direction of the zero position, so that the deflection device also functions effectively and efficiently at increased frequencies.

Preferably, the chamber includes an adjustable chamber wall. In this way, the chamber volume may be adjusted according to the given requirements. The sound pressure generated by the device of the invention in operation depends on the chamber volume and on the amount of air introduced into the chamber. Consequently, the sound pressure may be flexibly regulated by means of the adjustable chamber wall.

It is especially favorable when the gas flow is formed by the inlet flow of an engine. In this way, the energy necessary for the noise reduction of engines is directly taken from the gas or air flow, so that no complex power supplies are required for the operation of the device.

It is also possible, however, that the gas flow will be formed from a separate supply of compressed air. Generally, the gas or air flow may be generated from the existing units, whereby the supply with compressed air represents an example of such a unit.

In particular, the flow duct may be formed by the engine intake of an aircraft.

According to one aspect of the invention, using the device of the invention in an engine, particularly in an aircraft engine is suggested.

According to another aspect of the invention, a procedure for active noise reduction is presented, which includes the following steps:

at least partial deflection of a gas flow into a chamber, in order to increase the pressure in the chamber;

guiding the gas flow around the chamber, when a maximum pressure is reached inside of the chamber;

guiding gas, which is in the chamber, back into the gas flow, in order to release pressure in the chamber;

whereby these steps are executed periodically in sequence.

For noise reduction, very loud sound levels may be generated by the method of the invention, although only very little power is needed to achieve this. An especially high degree of efficiency results with the method of the invention, since the energy for the reduction of noise is taken from the existing gas or air flow.

Advantageously, the method of the invention is performed with the device of the invention. It is especially suited in the operation of an engine. Thereby the sound radiation of engines can be considerably reduced. The characteristics and advantages mentioned above in relation to the device, also apply to the method of the invention.

Furthermore, an engine for aircrafts is proposed, which includes a device of the invention for active noise reduction as described herein.

In the following, the invention is described by way of example in form of drawings.

DETAILED DESCRIPTION OF THE INVENTION

Figure 1A:
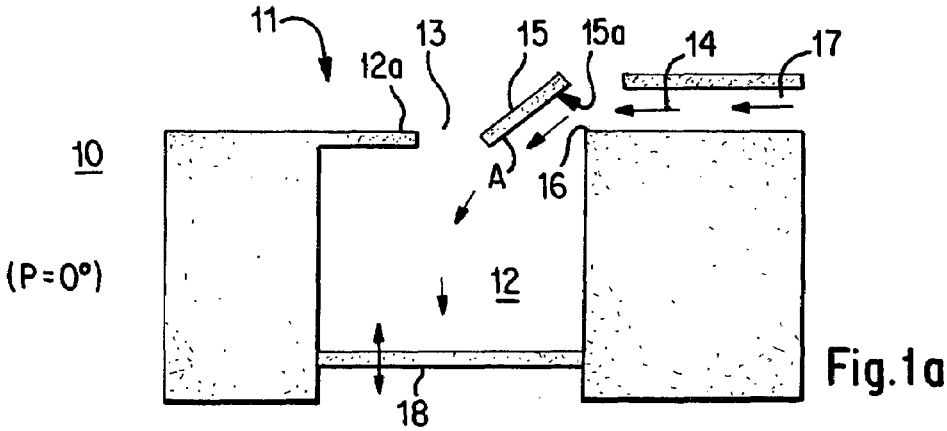
FIGS. 1*a-d* show a preferred embodiment of the invention schematically in cross section in various operating phases.

FIG. 1*a* shows a device 10 for sound absorption in a first operating phase. The device 10 consists of a housing 11, in whose interior a chamber 12 is constructed. The chamber 12 has a chamber opening 13 in a wall 12*a*, which is positioned on one side of the chamber 12, over which an air or gas flow 14 passes during operation. The wall 12*a* of the chamber 12, in which the chamber opening 13 is located, is aligned parallel to the direction of the gas flow 14 situated upstream of the chamber 12.

In the area of the chamber opening 13 a deflection device 15 is arranged, which has the form of a plate in the present example. The deflection device 15 is pivoted around an axis A, which is vertically oriented toward the direction of the thereto guided gas flow 14.

The plate-shaped deflection-device 15 may take various positions, which allow for the gas flow 14 to be at least partially directed into the chamber, or to direct the gas out of the chamber 12 towards the gas flow 14 running by outside of the chamber opening 13. In the first phase shown in FIG. 1*a*, the deflection device 15 is tilted towards the gas flow 14, so that the flowing gas meets the diagonally positioned underside 15*a* of the deflection device 15, so that it is deflected in its direction of flow and is directed into the chamber 12. In this first phase, a pressure increase or counter pressure builds up due to the gas flowing into the chamber 12.

At the end of the chamber opening 13 positioned upstream, there is an edge 16, so that the gas from the gas flow 14, due to the deflection or by the change in direction of the flow caused by the deflection device 15, is directed around the edge 16, or sweeps over the edge when it enters through the chamber opening 13 into the chamber 12.

A flow duct 17 is constructed at the side of the chamber 12 which serves as a guide for the gas flow 14 and which may be an integral part of the device 10. But it is also possible for the device 10 to be attached laterally to an existing flow duct.

On one side of the chamber 12, there is an adjustable chamber wall 18, so that the chamber volume can be regulated variably. In the example shown here, the adjustable chamber wall 18 is arranged on the opposite side of the chamber opening 13: of the chamber 12. A control and drive mechanism not shown in the figures is coupled to the adjustable chamber wall 18, in order to control the chamber volume and adjust it as needed.

Figure 1B:
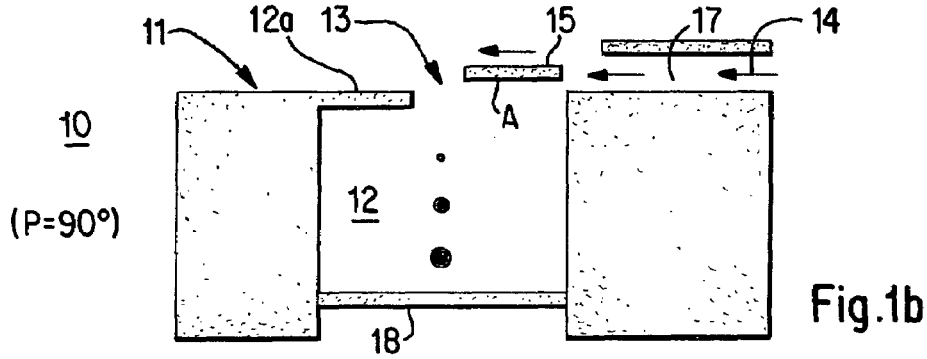

FIG. 1*b* shows the device 10 in a second phase (90°), in which the plate-shaped deflection device 15 is aligned parallel to the direction of the gas flow 14. In this position the gas flow 14 is not redirected, but it sweeps over the chamber opening 3 above the plate-shaped deflection device 15, so that the gas is directed around the chamber 12. In this phase, the pressure in the chamber 12 has reached its maximum value. In the figure, the pressure is symbolized schematically with circles, whereby the diameter represents a measure for the amplitude. In this case, the black circles in FIG. 1*b* designate an overpressure present in the chamber 12, as opposed to the areas of the gas flow lying outside of the chamber.

Figure 1C:
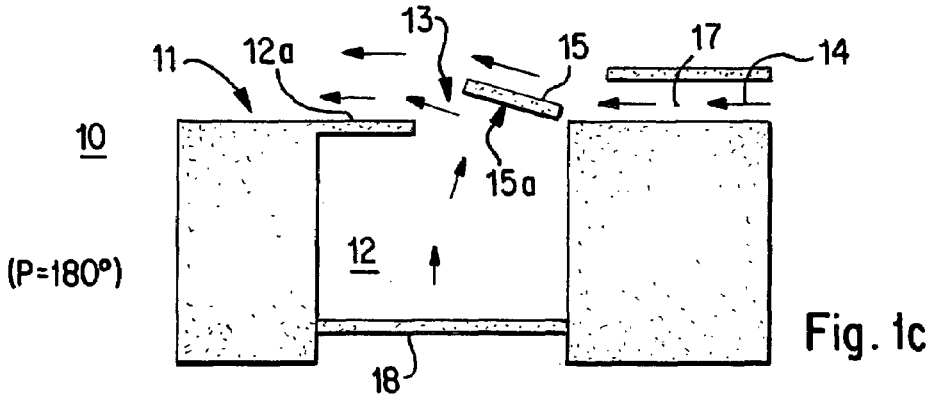

FIG. 1*c* shows the device 10 in a third phase (180°), in which the deflection device 15 is tilted in such a way that the gas flowing in the flow duct 17 is directed around its top side, and does not enter into the chamber 12, whereas on the other hand, the gas inside the chamber 12, can exit through the chamber opening 13, so that the gas inside the chamber can expand. The deflection device 15 is positioned diagonally in relation to the direction of flow of the gas flow 14, so that the chamber opening 13 is closed for the gas flowing thereto. On the underside 15*a* of the tilted deflection device 15, the gas from the chamber 12 is directed towards the gas flow guided around the top side.

Figure 1D:
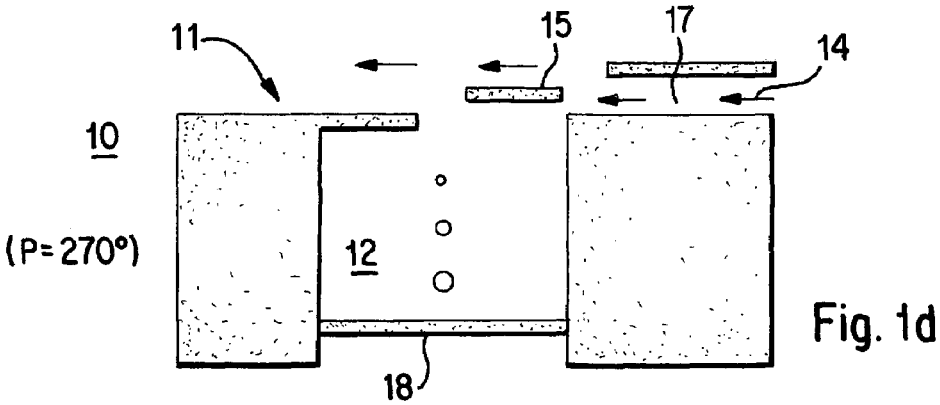

FIG. 1*d* shows the device of the invention 10 in a fourth phase (270°), in which a minimum pressure exists in the chamber 12. In this phase the minimum pressure was brought about by the sluggishness of the expansion process shown in FIG. 1*c*. In the herein shown phase four, the deflection device 15 is again in parallel alignment to the direction of the gas flow 14, so that the gas flow 14 is guided around the chamber opening 13 by means of the deflection device 15. The vacuum existing in the chamber 12 in this phase is symbolized by white circles in FIG. 1*d*.

Subsequently, the cycle starts from the beginning, i.e. as shown in the first phase according to FIG. 1*a*, gas or air is introduced into the chamber 12 by means of the deflection device 15, and thereafter, the additional phases run through.

As shown above in FIGS. 1*a*-1*d*, the air or gas flow is controllably directed into the chamber 12 by means of the deflection device 15. By adjusting the deflection device 15, an alternating pressure is produced inside the chamber 12. The alternating pressure is radiated as sound through the chamber opening 13. In operation, the air or gas flow is directed out proportionally to the excitation signal of the deflection device 15.

The frequency of the radiated sound is determined by the duration of the shown phases. The phase of the sound pressure fluctuations is in a fixed relationship to the phase of the introduced gas flow into the chamber 12. The sound pressure is dependent on the amount of air introduced into the chamber 12, and on the chamber volume. By means of a suitable control unit, the amplitude of the excitation signal is used for the deflection device 15 to direct the introduced amount of air. The chamber volume is regulated by means of the adjustable chamber wall 18.

Aeroacoustic sound origination mechanisms are utilized for noise reduction in the invention. Moreover, the required power is taken from the available gas flow. For this purpose, the gas flow is redirected into the laterally attached chamber 12, where it is decelerated and compressed because of the limited available chamber volume. Subsequently, the gas flow is guided around the chamber opening 13, whereby the compressed gas is allowed to release in the chamber 12 via the chamber opening 13. The sound generated by the change in density is radiated through the chamber opening 13. It overlays the disturbing original sound field and, by means of suitable control of the phases and frequencies, results in the partial cancellation of the original present, disturbing sound.

Despite low power consumption of the device of the invention 10, extremely loud sound levels can be generated for canceling out of the disturbing sound field, whereby the construction is very simple and takes up only little space and weight.

The invention claimed is:

1. A noise reduction device, comprising:

a housing in which a chamber is constructed and having a chamber opening constructed in a wall of the chamber and laterally arranged in relation to a gas flow, and a deflection device, which is adjustably arranged at the chamber opening so as to tilt between a first position, in which a diagonally positioned underside of the deflection device is met by the gas flow so that the underside at least partially directs the gas flow running by the chamber opening into the chamber in order to compress gas there, and a second position, in which the deflection device is positioned so that a diagonally positioned top side of the deflection device is met by the gas flow and the chamber opening is closed for the gas flow, and the underside of the deflection device directs the gas out of the chamber towards the gas flow in order to release the gas inside the chamber, thereby generating a periodically alternating pressure in the chamber.

2. The device according to claim 1, wherein the deflection device is a gate, pivoted around an axis, which is vertically aligned toward the direction of flow of the gas flow.

3. The device according to claim 2, wherein the deflection device is an oscillating plate.

4. The device according to claim 2, wherein the chamber is a resonator, and wherein the deflection device is positioned at an upstream edge of the chamber opening.

5. The device according to claim 1, wherein the deflection device is an oscillating plate.

6. The device according to claim 1, wherein the chamber is a resonator, and wherein the deflection device is positioned at an upstream edge of the chamber opening.

7. The device according to claim 1, wherein a flow duct for the gas flow is arranged upstream of the chamber opening.

8. The device according to claim 7, wherein the flow duct is realized by an intake of an aircraft engine.

9. The device according to claim 1, wherein the underside of the deflection device, in the first position, faces the gas flow and is directed diagonally to the gas flow, and wherein the underside of the deflection device, in the second position, faces away from the gas flow while the top side faces the gas flow.

10. The device according to claim 1, and further comprising a control unit for regulating the deflection device.

11. The device according to claim 1, and further comprising a drive unit which is coupled to the deflection device.

12. The device according to claim 1, wherein the deflection device is an elastic element.

13. The device according to claim 1, wherein the chamber includes an adjustable chamber wall.

14. The device according to claim 1, wherein the gas flow is realized by an intake flow of an engine.

15. The device according to claim 1, wherein the gas flow is formed by a compressed air supply.

16. A use of a device according to claim 1 in an engine.

17. An aircraft engine comprising a noise reduction device according to claim 1.

* * * * *